US006994514B2

(12) United States Patent
Soechting et al.

(10) Patent No.: US 6,994,514 B2
(45) Date of Patent: Feb. 7, 2006

(54) TURBINE BLADE AND GAS TURBINE

(75) Inventors: Friedrich Soechting, Miami, FL (US); Yasuoki Tomita, Takasago (JP); Shunsuke Torii, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/299,711

(22) Filed: Nov. 20, 2002

(65) Prior Publication Data

US 2004/0096328 A1 May 20, 2004

(51) Int. Cl.
*F01D 5/18* (2006.01)

(52) U.S. Cl. ..... 415/115; 416/97 R

(58) Field of Classification Search ..... 415/115, 415/116, 173.4, 173.5; 416/90 R, 92, 96 R, 416/96 A, 97 R, 224
See application file for complete search history.

(56) References Cited

U.S. PATENT DOCUMENTS 4,390,320 A * 6/1983 Eiswerth ..... 416/97 R
4,893,987 A * 1/1990 Lee et al. ..... 416/92
5,192,192 A * 3/1993 Ourhaan ..... 416/97 R
6,231,307 B1 * 5/2001 Correia ..... 416/97 R
6,527,514 B2 * 3/2003 Roeloffs ..... 416/97 R
6,602,052 B2 * 8/2003 Liang ..... 416/97 R
2003/0021684 A1 * 1/2003 Downs et al. ..... 416/92

FOREIGN PATENT DOCUMENTS

EP 207799 A2 * 1/1987 ..... 416/92
JP 07-063002 3/1995

* cited by examiner

*Primary Examiner*—Christopher Verdier
(74) *Attorney, Agent, or Firm*—Oblon, Spivak, McClelland, Maier & Neustadt, P.C.

(57) ABSTRACT

Holes 38 and 39 have upstream opening portions 38*b* and 39*b* and downstream opening portions 38*a* and 39*a* which have a larger cross-sectional area than upstream opening portions 38*b* and 39*b*, and are formed at top portion TP of each moving blade. Holes 38 and 39 have tapered shapes T1 and T2 or step portions, and preferably, downstream opening portions 38*a* and 39*a* are eccentrically formed toward the moving direction. When tip squealer 37 is formed, hole 38 is formed so that its opening portion is provided at the side surface of tip squealer 37. Without covering the holes for cooling which are formed at the top portion of the turbine blade due to rubbing or the like, the turbine blade is accurately cooled and stably driven.

13 Claims, 5 Drawing Sheets

TURBINE BLADE AND GAS TURBINE

BACKGROUND OF THE INVENTION

1. Field of the Invention

The present invention relates to a gas turbine which is preferably used for a power plant or the like, and in particular, a turbine blade equipped with a cooling structure.

2. Description of Related Art

To improve heat efficiency of an industrial gas turbine used for a power plant or the like, it is effective that the temperature of a combustion gas (fluid) for operation at an inlet of the turbine is increased. However, since the heat resistance performance of each of the members which are exposed to the combustion gas, such as moving blades, stationary blades, and turbine blades, is limited by the physical characteristics of the materials used in the members, the temperature of the inlet of the turbine cannot be simply increased.

To solve the above problem, since the turbine blades are cooled by a cooling medium such as cooling air or the like, and simultaneously, the temperature of the inlet of the turbine is increased, the heat resistance performance of the turbine blades is maintained to improve the heat efficiency.

Examples of cooling methods for the turbine blade include a convection cooling method and an impingement cooling method in which the cooling medium passes through the inside of the turbine blade, and a film cooling method in which the cooling medium is injected to the outside surface of the turbine blade to form a film of the cooling medium.

Furthermore, a structure of a conventional moving blade (turbine blade) is explained below with reference to FIGS. 4A and 4B.

FIG. 4A is a perspective view explaining an example of a structure of moving blade member 50 and FIG. 4B is a cross-sectional view along the line C—C in FIG. 4A of a top portion TP which is a tip portion of moving blade 51. Moving blade 51, and tip squealers 54*a* and 54*b* (protrusion parts) which are provided on the top portion TP are shown in FIGS. 4A and 4B.

As shown in FIG. 4A, moving blade 51 is disposed upright on platform 55 which is provided on engaging part 56 fixed to a turbine rotor (not shown). At both side surfaces, high pressure side blade surface 53 (outside surface) and low pressure side blade surface 52 (outside surface) are provided. At high pressure side blade surface 53, a high pressure combustion gas flows due to the rotation of moving blade 51, and at low pressure side blade surface 52, a low pressure combustion gas at a pressure lower than the combustion gas flowing at high pressure side blade surface 53 flows.

As shown in FIG. 4B, at the top portion TP which is the tip portion of moving blade 51, the protrusion parts, called tip squealers 54*a* and 54*b*, having a height h2 are provided along both blade surfaces 52 and 53 of moving blade 51. These tip squealers 54*a* and 54*b* are used as portions to be abraded when the top portion TP makes contact with a wall surface at the opposite side when the turbine is started.

Moving blades 51 are arranged in a path of the combustion gas which blows out from a combustor (not shown). The path is composed of a wall surface of platform 55 and an inner wall surface (not shown) of a casing which forms the exterior of the turbine. The casing is a separating ring.

When the gas turbine is started, a high temperature gas collides against moving blade 51, resulting in the heat expansion of moving blade 51. The stationary blades of course also undergo heat expansion. However, since the casing does not make direct contact with high temperature gas, the casing undergoes heat expansion more slowly than these moving and stationary blades. Therefore, the casing cannot undergo heat expansion in response to the heat expansion of each blade. In this condition, since moving blades 51 and the like are rotated together with a rotation axis in the casing, the top portion TP of moving blade 51 may be abraded by making contact with the inner wall surface of the casing. This phenomenon is called "tip rubbing" and occurs because the top portion TP of moving blade 51 and the inner wall surface of the casing are closely formed so as to prevent pressure leakage from a space between the top portion TP and the inner wall surface.

Since tip squealers 54*a* and 54*b*, which are provided as the portions to be abraded or for holding pressure have a sufficient height h2, if tip rubbing is generated, the height h2 sufficiently corresponds to the portion to be abraded.

However, if such a relatively large concaving formed by tip squealers 54*a* and 54*b* is provided at the top portion TP of moving blade 51 which has a high temperature, disadvantages are generated in many respects. For example, since the top portion TP is separated from the surface to be cooled, it is difficult to cool the top portion TP. Therefore, the durability of the top portion TP with respect to the operating the turbine may be decreased by burnout of the top portion TP and the further generation of cracking.

To solve the above problems, the top portion TP of moving blade 51 has a structure as shown in FIGS. 5A and 5B. FIGS. 5A and 5B are cross-sectional views showing the top portion TP of moving blade 51. FIG. 5A shows a condition before the generation of tip rubbing and FIG. 5B shows a condition after the generation of tip rubbing.

FIG. 5A shows tip squealer 54 (protrusion part) which is formed along high pressure side blade surface 53, and plural holes 56 and 57 which are provided on the top portion end surface. Holes 56 and 57 are formed in two directions, respectively. One hole is formed so as to penetrate tip squealer 54 containing a step portion having a height of h3 which is lower than the height of tip squealer 54*a* shown in FIG. 4B. The other hole is formed at the end surface of top portion TP in which a portion corresponding to tip squealer 54*b* is removed.

Each of holes 56 and 57 communicates with cavity R in moving blade 51, and cooling medium inflowing into moving blade 51 is taken up from upstream opening portions 56*b* and 57*b* of holes 56 and 57 and is blown out from downstream opening portions 56*a* and 57*a*. As a result, the cooling medium blown out from the opening portions cools the top portion TP, blade surfaces 52 and 53, and the inner wall surfaces, which face the blade surfaces, of the casing.

Upstream opening portions 56*b* and 57*b* and downstream opening portions 56*a* and 57*a* are holes having the same cross-sectional area about 1 mm in diameter, and are generally formed by electric discharge machining, laser beam machining, or the like.

According to the above constitution, since the cooling medium blown out from holes 56 and 57 is used to cool the top portion TP and the like, the thermal stress of tip squealer 54 is relaxed and is prevented from burning out and cracking. Furthermore, since the height of tip squealer 54 is lower than the height of tip squealer 54*b* shown in FIG. 4B and a tip squealer is provided at only one side of moving blade tip 51, a thermal stress concentration is avoided to a large extent and burnout and cracking are prevented.

However, in moving blade 51 as a conventional turbine blade, when tip rubbing is generated on the top portion TP, the periphery of each of holes 56 and 57 of the cooling medium is abraded, resulting in a problem wherein these holes 56 and 57 are covered. This is because the member of the top portion TP is deformed by abrasion and burrs, for example, remain at the periphery of each of holes 56 and 57 in the deformed member.

The condition after the generation of tip rubbing is explained below with reference to FIG. 5B. When the top portion TP of moving blade 51 makes contact with the inner wall surfaces of the casing due to heat expansion, the top portion TP is gradually abraded removing the portion having a height α. Simultaneously, holes 56 and 57 formed at the end surface of the top portion TP are abraded forming downstream opening portions 56*a*' and 57*a*' whose ends are shifted downward. At the same time, the periphery of each of downstream opening portions 56*a*' and 57*a*' is abraded generating burrs. The cross-sectional area of each of downstream opening portions 56*a*' and 57*a*' is decreased by the burrs which remain and clogging is generated in holes 56' and 57'. Therefore, it is difficult to blow out the cooling medium from the top portion TP.

When attempting to make the cooling medium in the cavity R of moving blade 51 flow to holes 56' and 57' from upstream opening portions 56*b* and 57*b*, since downstream opening portions 56*a*' and 57*a*' are covered, a sufficient amount of cooling medium cannot be blown out to the top portion TP for cooling. If cooling of the top portion TP is not normally carried out, problems arise in that burnout and cracking are generated on the top portion TP and that the durability of the turbine is decreased.

BRIEF SUMMARY OF THE INVENTION

In view of the above problems, an object of the present invention is the provision of a turbine blade and a gas turbine thereof which can be stably driven by cooling the turbine blade accurately without closing the holes for cooling, which are formed on the top portion of the turbine blade, due to tip rubbing or the like.

In order to solve the above problems, the following structures are adopted in the present invention.

The first aspect of the present invention is the provision of a turbine blade arranged in a flow path, wherein plural holes are provided at a top portion of the turbine blade for blowing out cooling medium to an outside surface, and wherein the cross-sectional area of a hole provided at a downstream opening portion is larger than the cross-sectional area of a hole provided at an upstream opening portion.

Plural holes for cooling the outside surface of the turbine blade are provided on the top portion which is a tip portion of the turbine blade. The cooling medium flows from the inside of the turbine blade toward the outside of the top portion and is blown out from the holes.

The diameter of the section area of the hole provided at the upstream side and that of the hole provided at the downstream side differ from each other. The hole provided at the downstream opening portion at which the cooling medium is blown out to the outside of the turbine blade has a larger cross-sectional area than the hole provided at the upstream opening portion at which the cooling medium flows into each hole.

Therefore, the cooling medium inflows from the upstream opening portion having a relatively small diameter and blows out from the downstream opening portion having a relatively large diameter.

Furthermore, even if tip rubbing is generated, the cooling medium is always blown out to the outside of the top portion without closing the downstream opening portion.

Therefore, a turbine blade having high durability can be provided by preventing the burnout of the top portion, generation of cracking, and the like.

In the turbine blade according to the first aspect of the present invention, each hole may have a tapered shape.

Holes provided at the downstream opening portion have a larger cross-sectional area than holes provided at the upstream opening portion in the flow direction of the cooling medium. The variation in the diameter of each hole provided at the upstream opening portion and the diameter of each hole provided at the downstream opening portion is connected by a tapered portion, and as a result, the cross-sectional area of the hole at the upstream opening portion is gradually enlarged to the cross-sectional area of the hole at the downstream opening portion to form each hole. The cooling medium is blown out from each hole having a tapered shape to cool the turbine blade and the like. The cooling medium is smoothly passed through the holes toward the top portion.

When the hole is formed in a tapered shape, for example, even if the hole is partly covered with burrs or the like due to abrasion of the top portion, since the cross-sectional area of the hole is larger than that of the upstream opening portion, it is unlikely for the partly-covered hole to become smaller than the upstream opening portion in cross-sectional area from the condition of the generation of burrs.

Furthermore, if the angle of the tapered shape is increased, the angle between the wall surface and the end surface of the top portion has a gentle slope. As a result, the generation of burrs can be prevented, and the clogging of the holes is prevented, thereby cooling the turbine blade.

In the turbine blade according to the first aspect of the present invention, each hole may have a step portion having two or more steps which have different cross-sectional areas.

The hole provided at the downstream opening portion has a larger cross-sectional area than the hole provided at the upstream opening portion in the flow direction of the cooling medium. The variation in the cross-sectional area (diameter) of each hole provided at the upstream opening portion and the cross-sectional area (diameter) of each hole provided at the downstream opening portion is connected by the step portion. The cooling medium is blown out from each hole having the step portion to cool the turbine blade and the like.

If the top portion of the turbine blade is abraded and the holes are partly covered by burrs or the like, the cross-sectional area of the holes for the height of the portion which is estimated to be abraded should be preferably formed. As a result, even if the downstream opening portion is gradually abraded, a downstream opening portion having a large cross-sectional area can be ensured. In addition, clogging of the holes due to the generation of burrs or the like by tip rubbing is prevented, thereby ensuring the holes will be open.

In the turbine blade according to the first aspect of the present invention, the downstream opening portion of each hole may be formed so as to flare in a direction opposite to the relative moving direction of a wall surface facing the top portion.

The top portion of the turbine blade is provided close to the wall surface which it faces and moves relative to the top portion. If the wall surface and the top portion make contact with each other during relative movement, the top portion in which the holes are formed is gradually abraded. As the top portion is abraded, burrs or the like are generated in the holes due to tip rubbing or the like along the relative moving direction of the wall surface. However, since the downstream opening portion, which is formed larger than the upstream opening portion in cross-sectional area, is formed so as to flare toward the relative moving direction of the wall surface, burrs or the like are prevented from directly covering the downstream opening portion. That is, the cooling medium blowing out from the holes can be blown out without being blocked by burrs or the like even if burrs or the like are generated. Furthermore, if each hole has a tapered shape, since the portion on which the burrs are generated is smoothly formed, the effect of the burrs on the holes is remarkably decreased.

In the turbine blade according to the first aspect of the present invention, a protrusion portion may be provided on at least one shoulder in which an outside surface of the protrusion portion elongates along the outside surface of the turbine blade and an inside wall of the protrusion portion protrudes from the top portion, and the holes may be provided along the inside wall of the protrusion portion.

On the top portion of the turbine blade, the protrusion portion is formed so as to elongate along the outside surface of the turbine blade and the holes through which the cooling medium is blown out are formed along the inside wall of the protrusion portion. Even if the protrusion portion is abraded by tip rubbing or the like to produce burrs or the like, since the holes are provided perpendicular to the inside wall of the protrusion portion, the holes are ensured without being blocked by the burrs or the like.

These holes are formed from the upstream opening portion toward the end surface of the top portion. When an upper portion of each hole provided at the protrusion portion is covered by burrs or the like, the hole becomes as if it is provided at the inside wall of the protrusion portion, in other words, the hole can be approximately perpendicular to the longitudinal direction of the turbine blade. Therefore, the cooling medium is accurately blown to the top portion for effective cooling, and burnout of the top portion and the generation of cracking are prevented to provide a turbine blade having improved durability.

The second aspect of the present invention is the provision of a gas turbine equipped with a compressor for compressing air, a combustor for generating high-temperature and high-pressure fluid, and a turbine for generating engine torque by converting energy of the fluid into mechanical work, wherein the turbine blade according to the above aspect is provided in the turbine.

The turbine blade is equipped with plural holes for blowing out the cooling medium, in which a downstream opening portion and an upstream opening portion are formed in each hole so that the downstream opening portion has a larger cross-sectional area than the upstream opening portion. The turbine blade is equipped in the turbine of the gas turbine.

Therefore, since the holes provided at the top portion of the turbine blade are not covered even if burrs are generated by tip rubbing, the cooling medium for cooling the turbine blade is blown out from the holes. Then, by adopting a turbine blade which includes an outside surface and a top portion to be cooled, the heat resistance property of the turbine blade is maintained while the temperature of the inlet of the turbine is increased to a high temperature, and the gas turbine can be driven. Furthermore, the cooling property of the turbine blade is maintained from the initial operation, thereby providing a gas turbine having reliability, durability, and simple maintenance.

DETAILED DESCRIPTION OF THE INVENTION

An embodiment according to the present invention is explained with reference to the figures.

Figure 1:
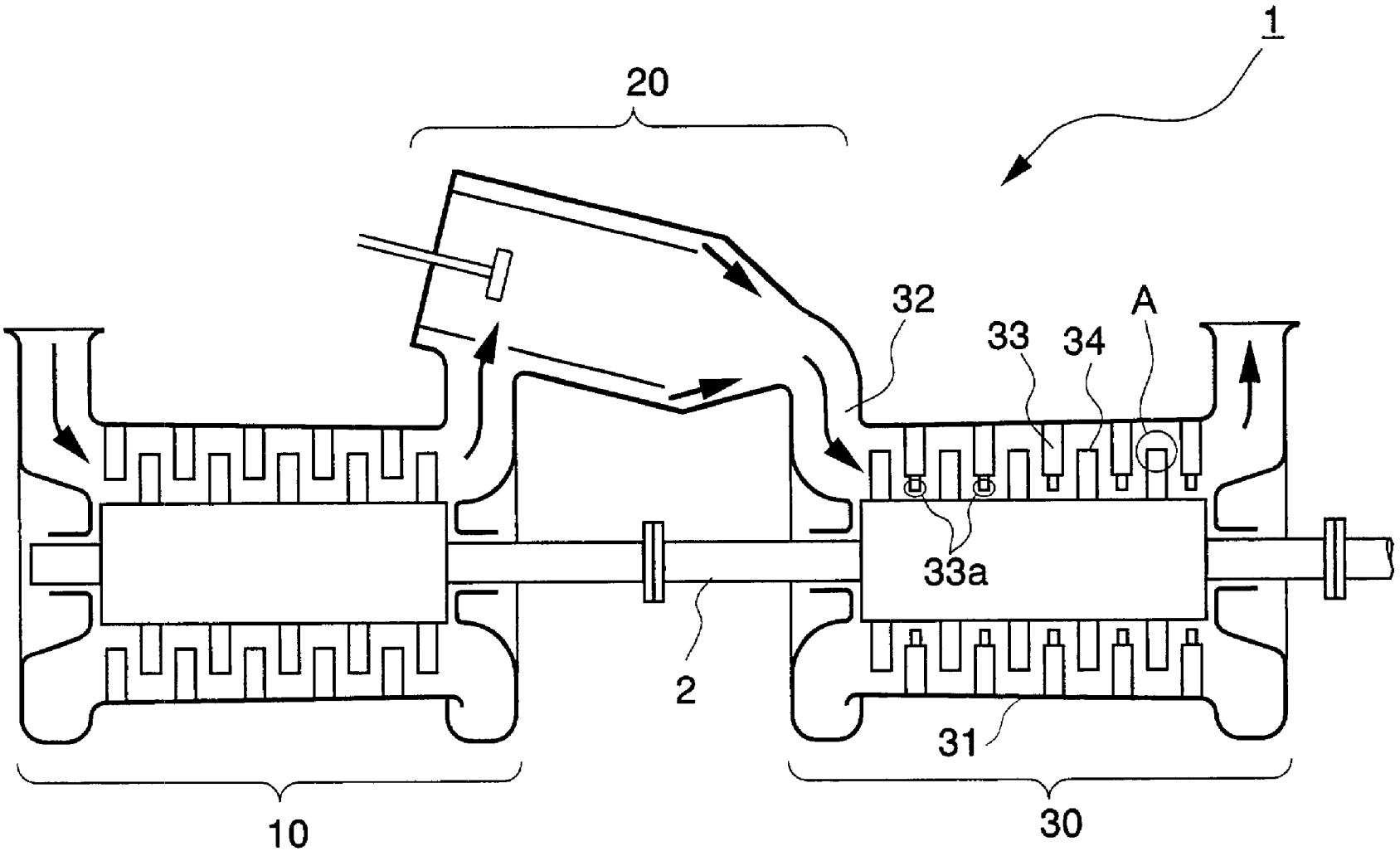
FIG. 1 is a cross-sectional view explaining a schematic structure of a gas turbine according to the first embodiment of the present invention.

FIG. 1 is a cross-sectional view explaining a schematic structure of gas turbine 1 according to the embodiment. FIG. 1 shows compressor 10, combustor 20, and turbine 30. Compressor 10 is connected to turbine 30 by rotational shaft 2, and combustor 20 is provided between compressor 10 and turbine 30.

Compressor 10 compresses a large amount of air therein. In gas turbine 1, generally, a part of the power of turbine 30 obtained by rotational shaft 2 is used as power for compressor 10 (compressor input).

Combustor 20 carries out combustion after mixing the compressed air in compressor 10 and fuel to send a combustion gas (fluid) to path 32 which is connected to turbine 30.

Turbine 30 is equipped with rotational shaft 2 which extends from, at least, compressor 10 in casing 31 which forms the exterior of gas turbine 1, and plural moving blades 34 and stationary blades 33 (both are called "turbine blades").

Moving blades 34 are fixed around rotational shaft 2, and rotate rotational shaft 2 due to the pressure of the combustion gas flowing along the axial direction of rotational shaft 2.

Furthermore, stationary blades 33 are fixed around a separating ring which composes an inside wall of casing 31, and are used in order to change the direction, pressure, and speed of the flow in casing 31. At the top portion of stationary blade 33, shaft sealing mechanism 33*a* is provided at the top portion of stationary blade 33 to close the space between rotational shaft 2 and the top portion of stationary blade 33.

These moving blades 34 and stationary blades 33 are alternately provided in a path of the combustion gas formed between rotational shaft 2 and the inside wall surface of casing 31. The combustion gas generated in combustor 20 is introduced into path 32 and expands, and the expanded combustion gas is blown to these blades to generate power by converting thermal energy of the combustion gas into rotational energy of mechanical work. The power is used as power for compressor 10 as described above, and in general, the power is used as power for a generator of an electric power plant.

Figure 2A:
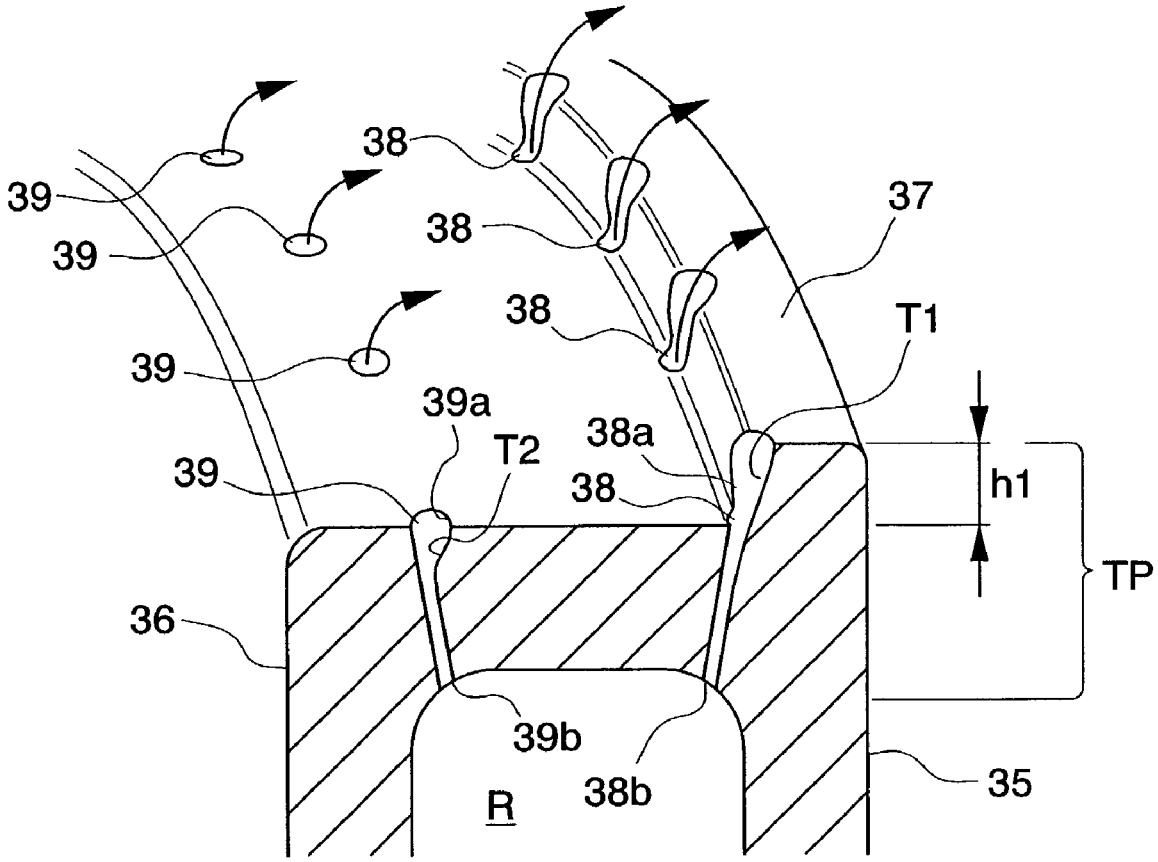
FIG. 2A is a perspective view of a cross-section explaining the top portion before the generation of tip rubbing, and explains a top portion of a moving blade shown by reference symbol A in FIG. 1 according to the first embodiment of the present invention.

Next, a structure of the top portion, which is a tip portion of moving blade 34 shown by reference symbol A of FIG. 1, is explained with reference to FIGS. 2A and 2B. FIG. 2A is a perspective view of a cross-section explaining the holes provided on the top portion, and FIG. 2B is a cross-sectional view of the top portion showing a condition after tip rubbing.

Figure 2B:
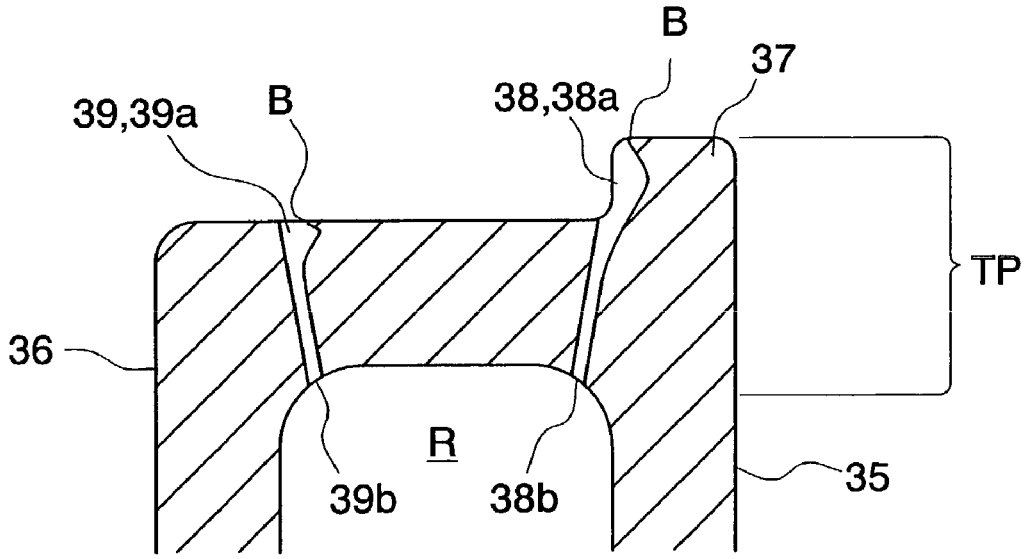
FIG. 2B is a cross-sectional view of the top portion after the generation of tip rubbing, and explains the top portion of the moving blade shown by reference symbol A in FIG. 1 according to the first embodiment of the present invention.

FIGS. 2A and 2B show holes 38 and 39 which are provided on the top portion TP from which the cooling medium is blown out. These plural holes 38 and 39 are formed at low pressure side blade surface 35 (outside surface) and at high pressure side blade surface 36 (outside surface), respectively. Tip squealer 37 (protrusion portion) is formed at low pressure side blade surface 35 so as to protrude at the top portion TP and holes 38 are formed at low pressure side blade surface 35 so as to be bored into the side wall surface of tip squealer 37.

Holes 38 and 39 are formed toward different directions, each connects cavity R inside moving blade 34 and the end surface of the top portion. The cooling medium flowing in cavity R is taken up from upstream opening portions 38*b* and 39*b* of holes 38 and 39, passes through paths T1 and T2 having tapered shapes, is introduced into downstream opening portions 38*a* and 39*a* connected to paths T1 and T2, which have a larger cross-sectional area than upstream opening portions 38*b* and 39*b*, and is blown out the outside of moving blade 34.

In this embodiment, the diameter of each of upstream opening portions 38*b* and 39*b* is about 0.8 to 1.0 mm, and the diameter of each of downstream opening portions 38*a* and 39*a* is about 2 to 3 mm. Holes 38 and 39 are shown as holes each having a cylindrical shape in FIGS. 2A and 2B, however, they are not limited to this. For example, holes 38 and 39 may have an elliptical, triangular, or polygonal shape, and the like.

When moving blade 34 rotates in the direction of rotation so as to move left to right in the figure, the top portion TP of moving blade 34 may make contact with the inside wall surface of casing 31 (refer to FIG. 1). This is because heat expansion is caused by blasting combustion gas having a high temperature onto moving blade 34. As a result, the height of moving blade 34 is increased to make contact with the inside wall surface of casing 31.

The heat expansion of casing 31 is slower than that of moving blade 34. Moving blade 34 undergoes heat expansion before casing 31 and makes contact with casing 31 which undergoes slow heat expansion. The phenomenon is remarkably generated during the warm-up and starting of gas turbine 1. The wall surface facing the top portion TP is the inside wall surface of casing 31 and moves relative to the actual movement of moving blade 34.

When the top portion TP contacts the inside wall surface of casing 31, the top portion TP is gradually abraded. This is called rubbing.

When rubbing is generated at the top portion TP, tip squealer 37 is abraded as shown in FIG. 2B generating burrs B on holes 38 formed in tip squealer 37 and on holes 39 formed in the end surface of the top portion. These burrs B are formed such that they cover holes 38 and 39 in the rotational direction.

However, since holes 38 and 39, which are formed at the top portion TP in the present embodiment, are formed into tapered shapes having cross-sectional areas of two or three times the diameter of the upstream opening portions 38*b* and 39*b*, holes 38 and 39 are not covered by burrs B. Therefore, the cooling medium in cavity R is easily blown out from each of holes 38 and 39, and the cooling medium blown out flows from the high pressure side to the low pressure side to cool the top portion TP, tip squealer 37, blade surfaces 35 and 36, the inside wall surface of casing 31 which faces the top portion TP, and the like.

According to the above embodiment of moving blade 34, even if rubbing is generated, holes 38 and 39 blowing out the cooling medium are not covered, and moving blade 34 is accurately and continuously cooled. Simultaneously, since the heat load of tip squealer 37 and top portion TP is decreased, defects such as burnout and cracking are prevented so as to allow stable driving of gas turbine 1.

A modified example of the present embodiment may have the following structure.

Figure 3A:
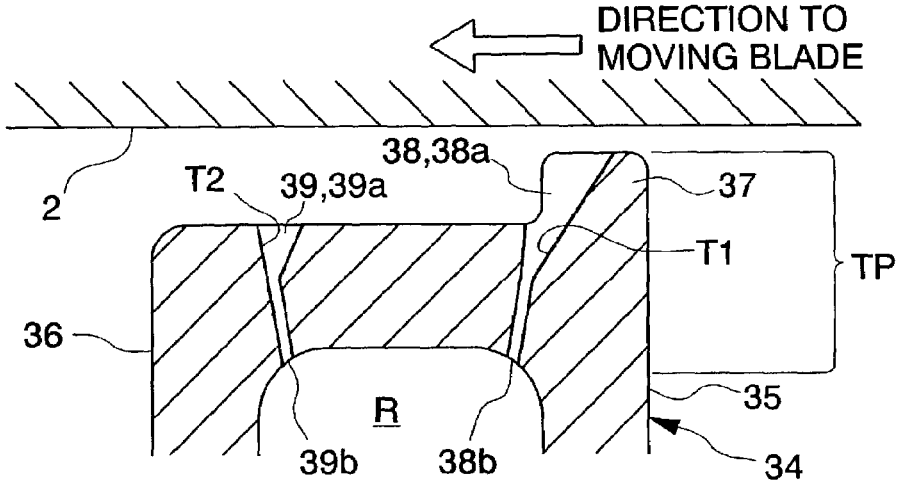
FIG. 3A is a cross-sectional view of the top portion equipped with holes having an eccentrically tapered shape, and shows a modified example of the top portion of the moving blade according to the first embodiment of the present invention.
Figure 3B:
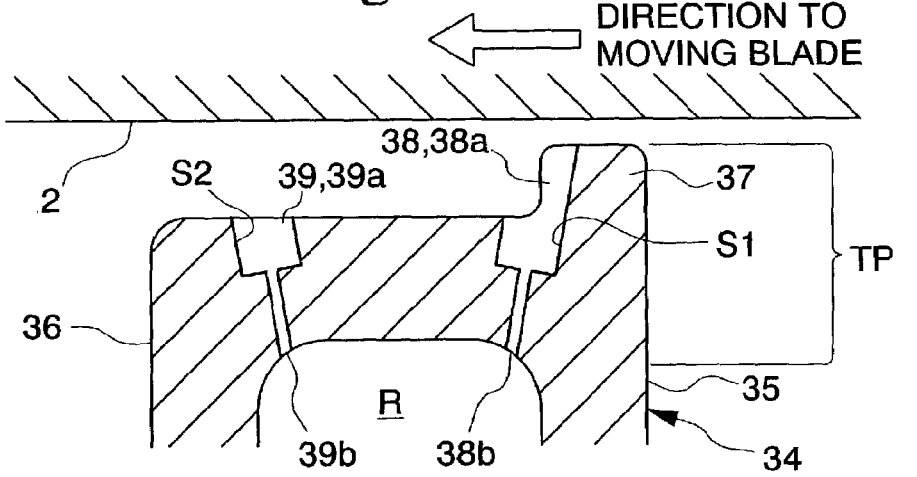
FIG. 3B is a cross-sectional view of the top portion equipped with holes having a step portion, and shows a modified example of the top portion of the moving blade according to the first embodiment of the present invention.
Figure 3C:
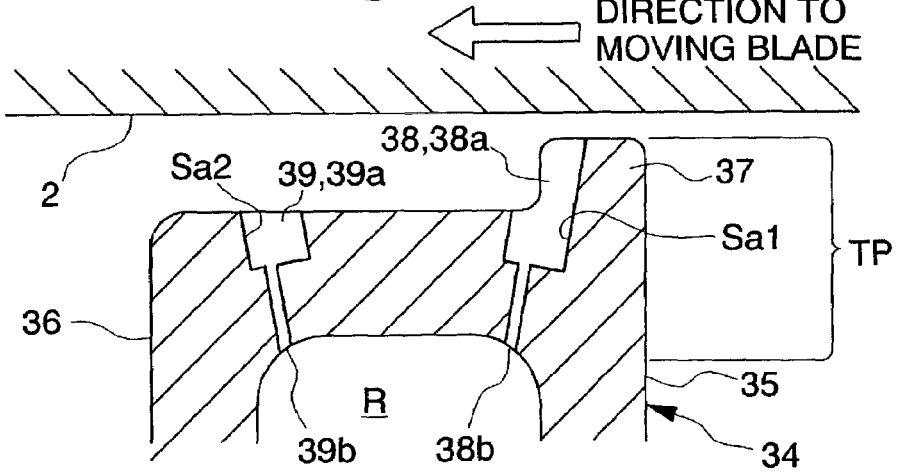
FIG. 3C is a cross-sectional view of the top portion equipped with holes having an eccentrically stepped portion, and shows a modified example of the top portion of the moving blade according to the first embodiment of the present invention.
Figure 4A:
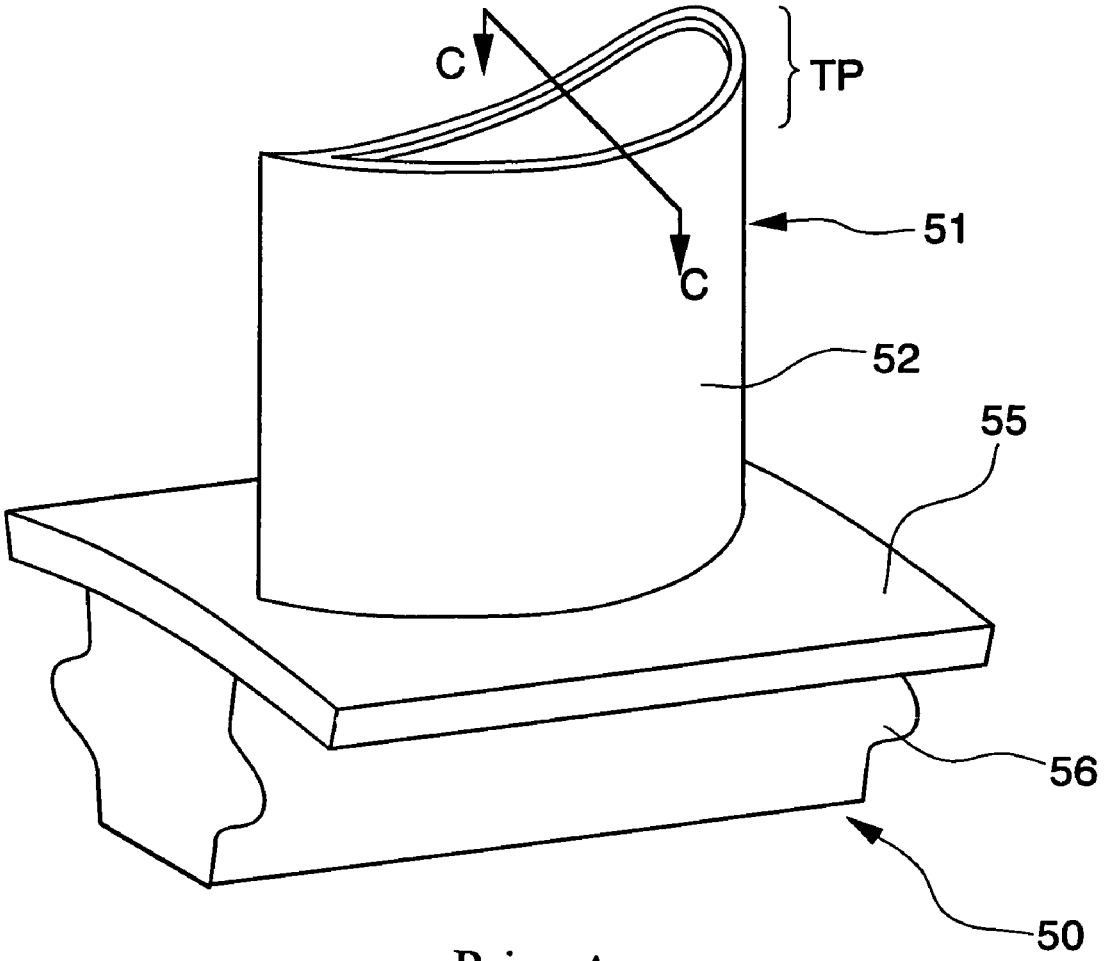
FIG. 4A is a perspective view of an example of a structure of the parts of the moving blade, and explains a conventional moving blade.
Figure 4B:
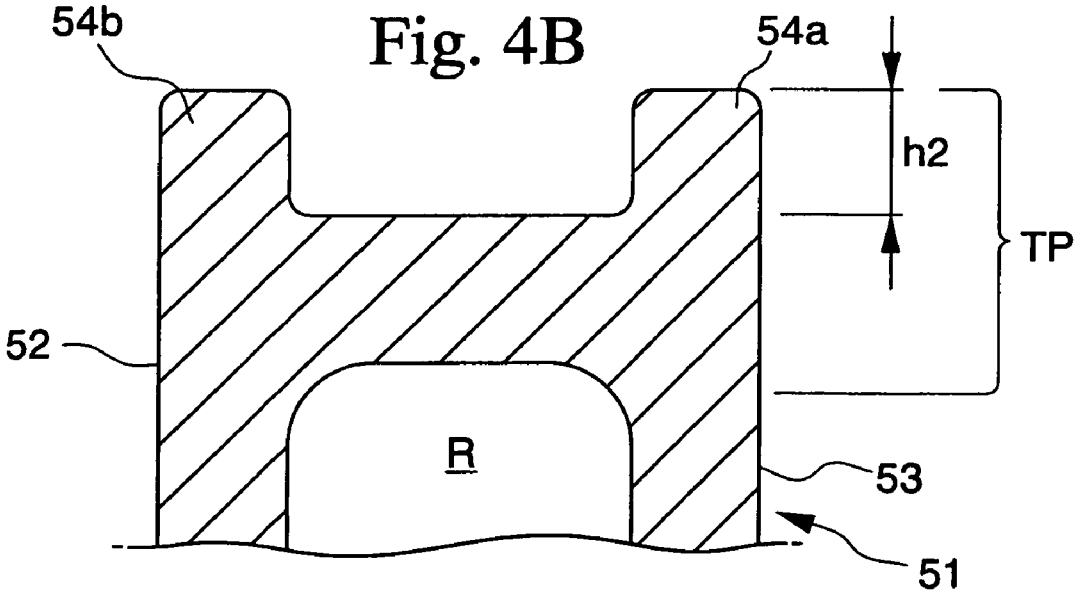
Prior Art Fig. 4B
FIG. 4B is a cross-sectional view of a top portion along line C—C shown in FIG. 4A.
Figure 5A:
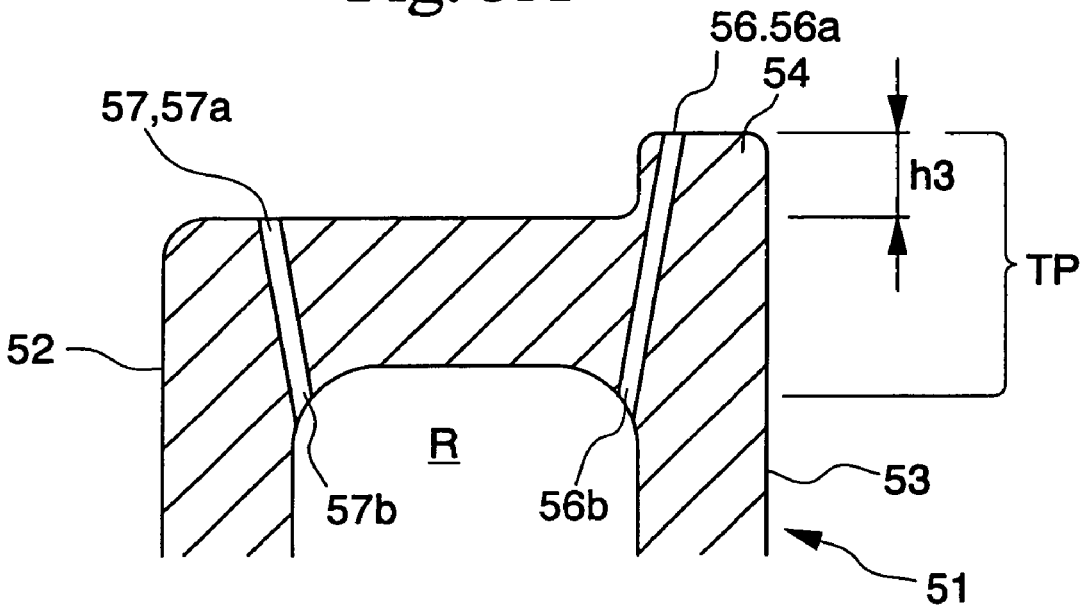
FIG. 5A is a cross-sectional view of the top portion before the generation of tip rubbing, and explains the top portion of a conventional moving blade.
Figure 5B:
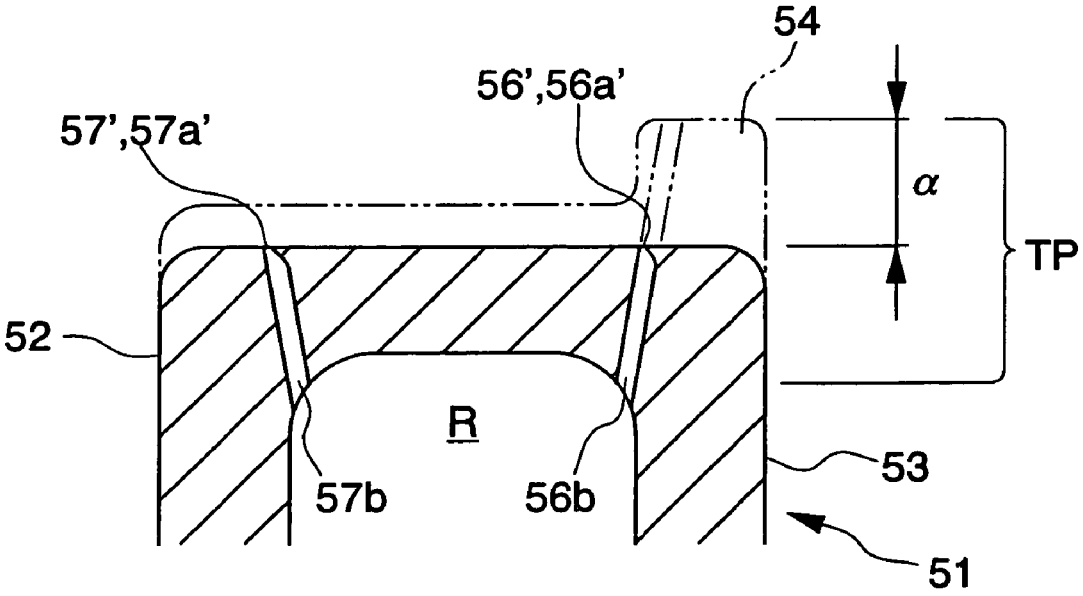
Prior Art Fig. 5B
FIG. 5B is a cross-sectional view of the top portion after the generation of tip rubbing, and explains the top portion of a conventional moving blade.

FIGS. 3A to 3C are cross-sectional views of the top portion TP of moving blade 34 showing a modified example of the present embodiment. An explanation of the reference numbers shown in FIGS. 3A to 3C is omitted because the reference numbers are the same as the numbers described in the above embodiment.

FIG. 3A is a sectional view of the top portion TP equipped with holes 38 and 39 having tapered shapes T1 and T2 in which the center of each of downstream opening portions 38*a* and 39*a* is eccentrically formed in comparison with the center of each of upstream opening portions 38*b* and 39*b*.

Holes 38 and 39 connecting cavity R of moving blade 34 and the end surface of the top portion are enlarged in their cross-sectional areas from upstream opening portions 38*b* and 39*b* each having a narrow diameter of about 1 mm along the tapered shapes T1 and T2. If moving blade 34 is regarded as being in a stationary state, the enlarged direction of the cross-sectional area is off to the right side of the figure. The direction is opposite to the relative moving direction of the inside wall surface of casing 2 which faces moving blade 34. The center of each of downstream opening portions 38*a* and 39*a* is eccentrically provided so as to flare toward the opposite direction of the relative moving direction of the inside wall surface of casing 2, in comparison with the center of upstream opening portions 38*b* and 39*b*.

According to the eccentricity of downstream opening portions 38*a* and 39*a*, the angle between the end surface of the top portion and the wall surface of each of tapered shapes T1 and T2 respectively is decreased.

Therefore, even if burrs are generated, covering of holes 38 and 39 becomes difficult. Furthermore, since the portions at which burrs are generated have a gentle angle, the generation of burrs is decreased.

Next, holes 38 and 39 having step portions are explained with reference to FIGS. 3B and 3C. FIGS. 3B and 3C are cross-sectional views of a cross-section of the top portion TP of moving blade 34, similar to FIG. 3A.

Holes 38 and 39 having step portions S1 and S2 are explained with reference to FIG. 3B. Holes 38 and 39 have upstream opening portions 38*b* and 39*b* each having a diameter of approximately 1 mm, and downstream opening portions 38*a* and 39*a* each having a diameter of 2 to 3 mm. Upstream opening portions 38*b* and 39*b* and downstream opening portions 38*a* and 39*a* are connected through step portions S1 and S2.

Accordingly, downstream opening portions 38*a* and 39*a* can be formed with a two to three times larger cross-sectional area than upstream opening portions 38*b* and 39*b* to prevent clogging of holes 38 and 39 by the generation of burrs. Furthermore, since step portions S1 and S2 are formed, holes 38 and 39 are easily formed by electric discharge machining, machining, or the like.

Furthermore, holes 38 and 39 having step portions S1 and S2 which are eccentrically provided are explained with reference to FIG. 3C.

Holes 38 and 39 connecting cavity R of moving blade 34 and the end surface of the top portion are enlarged in their cross-sectional areas from upstream opening portions 38*b* and 39*b* each having a narrow diameter of about 1 mm by step portions Sa1 and Sa2. If moving blade 34 is regarded as being in a stationary state, the enlarged direction of the cross-sectional area is off to the right side of the figure. The direction is opposite to the relative moving direction of the inside wall surface of casing 2 which faces moving blade 34. The center of each of downstream opening portions 38*a* and 39*a* is eccentrically provided so as to flare toward the relative moving direction of the inside wall surface of casing 2, in comparison with the center of upstream opening portions 38*b* and 39*b*.

Accordingly, downstream opening portions 38*a* and 39*a* can be formed with a two to three times larger cross-sectional area than upstream opening portions 38*b* and 39*b* to effectively prevent clogging of holes 38 and 39 by the generation of burrs. Furthermore, since step portions Sa1 and Sa2 are formed, holes 38 and 39 are easily formed by electric discharge machining, machining, or the like.

What is claimed is:

1. A turbine blade arranged in a flow path, comprising:

a top portion of the turbine blade having a plurality of holes for blowing out a cooling medium to an outside surface, wherein said plurality of holes have a cross-sectional area provided at a downstream opening portion that is larger than a cross-sectional area provided at an upstream opening portion, and wherein a center of the downstream portion of all of the plurality of holes is eccentrically provided to flare in a direction opposite to the relative moving direction of a wall surface facing the top portion.

2. A turbine blade according to claim 1, wherein each hole has a tapered shape.

3. A turbine blade according to claim 1, further comprising:

a protrusion portion provided on at least one shoulder, wherein an outside surface of the protrusion portion extends along an outside surface of the turbine blade and an inside wall of the protrusion portion protrudes from the top portion, and the holes are provided along the inside wall of the protrusion portion.

4. A turbine blade arranged in a flow path, comprising:

a plurality of holes provided on a top portion of the turbine blade for blowing out cooling medium to an outside surface, wherein a hole has a cross-sectional area provided at a downstream opening portion that is larger than a cross-sectional area provided at an upstream opening portion, and the downstream opening portion of each of said plurality of holes is formed to flare in a direction opposite to the relative moving direction of a wall surface facing the top portion, and each of said plurality of holes has a step portion having two or more steps which have different cross-sectional areas.

5. A gas turbine comprising:

a compressor for compressing air;

a combustor for generating a high-temperature and high-pressure fluid; and a turbine for generating engine torque by converting energy of the fluid into mechanical work, wherein the turbine blade according to any one of claims 1–4 and 3 is provided in the turbine.

6. A turbine blade adapted to move in a direction of blade movement, said turbine blade comprising:

a top portion including a plurality of channels provided therein, each of said plurality of channels including:

a first channel portion including a first cross-sectional area provided at a downstream opening portion; and a second channel portion in communication with said first channel portion, said second channel portion including a second cross-sectional area provided at an upstream opening portion smaller than said first cross-sectional area, wherein said first channel portion further includes:

a first inner wall portion inclined away from an axis of said channel in the direction of blade movement and forming a first angle with respect to said axis, and a second inner wall portion inclined away from said axis in a direction opposite to the direction of blade movement and forming a second angle with respect to said axis, wherein a magnitude of the first angle is greater than a magnitude of the second angle.

7. A turbine blade according to claim 6, wherein each of said plurality of channels has a tapered shape.

8. A turbine blade adapted to move in a direction of blade movement, said turbine blade comprising:

a top portion including a plurality of channels provided therein, each of said plurality of channels comprising:

a first channel portion including a first cross-sectional area provided at a downstream opening portion; and a second channel portion in communication with said first channel portion, said second channel portion including a second cross-sectional area provided at an upstream opening portion smaller than said first cross-sectional area, wherein each of said plurality of channels includes a step portion including two or more steps having different cross-sectional areas.

9. A turbine blade according to claim 6, further comprising:

a protrusion portion provided on at least one shoulder, wherein an outside surface of the protrusion portion extends along an outside surface of the turbine blade and an inside wall of the protrusion portion protrudes from the top portion, and the plurality of channels are provided along the inside wall of the protrusion portion.

10. A gas turbine comprising:

a compressor for compressing air;

a combustor for generating a high-temperature and high-pressure fluid; and a turbine for generating engine torque by converting energy of the fluid into mechanical work, wherein the turbine blade according to claim 6 is provided in the turbine.

11. A gas turbine comprising:

a compressor for compressing air;

a combustor for generating a high-temperature and high-pressure fluid; and a turbine for generating engine torque by converting energy of the fluid into mechanical work, wherein the turbine blade according to claim 7 is provided in the turbine.

12. A gas turbine comprising:

a compressor for compressing air;

a combustor for generating a high-temperature and high-pressure fluid; and a turbine for generating engine torque by converting energy of the fluid into mechanical work, wherein the turbine blade according to claim 8 is provided in the turbine.

13. A gas turbine comprising:

a compressor for compressing air;

a combustor for generating a high-temperature and high-pressure fluid; and a turbine for generating engine torque by converting energy of the fluid into mechanical work, wherein the turbine blade according to claim 9 is provided in the turbine.

* * * * *